US011214454B2

(12) United States Patent
Tajima et al.

(10) Patent No.: US 11,214,454 B2
(45) Date of Patent: Jan. 4, 2022

(54) MEDIUM FEEDING DEVICE AND IMAGE READING APPARATUS

(71) Applicant: SEIKO EPSON CORPORATION, Tokyo (JP)

(72) Inventors: Hiroyuki Tajima, Kitakyushu (JP); Koji Migita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 215 days.

(21) Appl. No.: 16/523,165

(22) Filed: Jul. 26, 2019

(65) Prior Publication Data

US 2020/0039771 A1 Feb. 6, 2020

(30) Foreign Application Priority Data

Jul. 31, 2018 (JP) ..... JP2018-144037

(51) Int. Cl.

| | |
|---|---|
| ***B65H 7/02*** | (2006.01) |
| ***B65H 3/52*** | (2006.01) |
| ***B65H 3/06*** | (2006.01) |
| ***B65H 3/56*** | (2006.01) |
| ***B65H 7/06*** | (2006.01) |

(52) U.S. Cl.

CPC ..... *B65H 7/02* (2013.01); *B65H 3/0669* (2013.01); *B65H 3/5261* (2013.01); *B65H 3/56* (2013.01); *B65H 7/06* (2013.01); *B65H 2404/166* (2013.01)

(58) Field of Classification Search

CPC .. B65H 3/0669; B65H 3/5261; B65H 3/0684; B65H 3/56; B65H 3/66; B65H 2404/166; B65H 2403/51

See application file for complete search history.

(56) References Cited

U.S. PATENT DOCUMENTS

| | | | | |
|---|---|---|---|---|
| 10,214,373 | B2 * | 2/2019 | Sata | B65H 3/0684 |
| 10,466,626 | B2 * | 11/2019 | Yang | G03G 15/6511 |
| 10,625,965 | B2 * | 4/2020 | Kuriki | B65H 3/0676 |
| 2017/0107068 | A1 | 4/2017 | Kanamitsu | |

FOREIGN PATENT DOCUMENTS

| | | |
|---|---|---|
| CN | 206142493 | 5/2017 |
| JP | 2012-051733 A | 3/2012 |
| JP | 2016-064899 A | 4/2016 |

* cited by examiner

*Primary Examiner* — Patrick Cicchino

(74) *Attorney, Agent, or Firm* — Workman Nydegger

(57) ABSTRACT

A medium feeding device includes a medium feeding mechanism switching between a first state in which the medium is fed from the feeding tray and a second state in which the medium is not fed from the feeding tray, a feeding roller rotationally driven in a forward rotation direction, and a separation roller that is rotationally driven in the reverse rotation direction when the feeding roller is rotationally driven in the forward rotation direction, wherein when the separation roller is rotationally driven in the forward rotation direction, the feeding roller is configured to be passively rotatable with respect to the separation roller, and wherein a rotation direction of the first motor when the cam member switches the medium feeding mechanism from the first state to the second state is the same as a rotation direction of the first motor when the separation roller rotates in the forward rotation direction.

16 Claims, 7 Drawing Sheets

MEDIUM FEEDING DEVICE AND IMAGE READING APPARATUS

The present application is based on, and claims priority from JP Application Serial Number 2018-144037, filed Jul. 31, 2018, the disclosure of which is hereby incorporated by reference herein in its entirety.

BACKGROUND

1. Technical Field

The present disclosure relates to a medium feeding device and an image reading apparatus provided with the medium feeding device.

2. Related Art

In a scanner, which is an example of an image reading apparatus, an automatic feeding device for a medium, which is a document, may be provided as a medium feeding device, and may be configured to perform automatic feeding and reading of a plurality of media. The medium automatic feeding device is also called an Auto Document Feeder, which may be abbreviated as an ADF.

The media set in the medium setting portion of the medium feeding device is fed by a rotationally driven feeding roller, and separated into one medium by a separation roller which nips and separates the media between the separation roller and the feeding roller to be transported into the device. The so-called active retard system, which is rotationally driven in the direction opposite to the medium feeding direction by a drive source such as a motor, may be employed for the separation roller in order to avoid multi feeding in which two or more media are fed.

In addition, such a medium feeding device may include a restriction section that restricts a movement of the medium before being fed by the feeding roller to the feeding roller. For example, JP-A-2016-064899 discloses a stopper 66 as a restriction section. The restriction section is configured to be switchable between a state in which the movement of the medium to the feeding roller is allowed to feed the medium, and a state in which the movement of the medium to the feeding roller side is restricted not to feed the medium.

The separation roller may be formed of an elastic material such as rubber as an example. When the separation roller of the active retard system is formed of an elastic material, the separation roller to which the driving force is continuously applied may be elastically deformed when the feeding roller is stopped.

SUMMARY

A medium feeding device according to an aspect of the present disclosure includes a medium mounting section on which a medium before feeding is mounted, a medium feeding mechanism switching between a first state in which the medium is fed from the medium mounting section and a second state in which the medium is not fed from the medium mounting section, a feeding roller rotationally driven in a forward rotation direction to feed the medium in a feeding direction, a separation roller that is configured to be rotationally driven in the forward rotation direction and in the reverse rotation direction opposite to the forward rotation direction, to which a predetermined rotational resistance is applied, and that is rotationally driven in the reverse rotation direction when the feeding roller is rotationally driven in the forward rotation direction to nip and separate the medium between the separation roller and the feeding roller, a motor driving the separation roller, and a cam member configured to switch between the first state and the second state of the medium feeding mechanism by power of the motor, wherein when the separation roller is rotationally driven in the forward rotation direction, the feeding roller is configured to be passively rotatable with respect to the separation roller, and wherein a rotation direction of the motor when the cam member switches the medium feeding mechanism from the first state to the second state is the same as a rotation direction of the motor when the separation roller rotates in the forward rotation direction.

DESCRIPTION OF EXEMPLARY EMBODIMENTS

Figure 1:
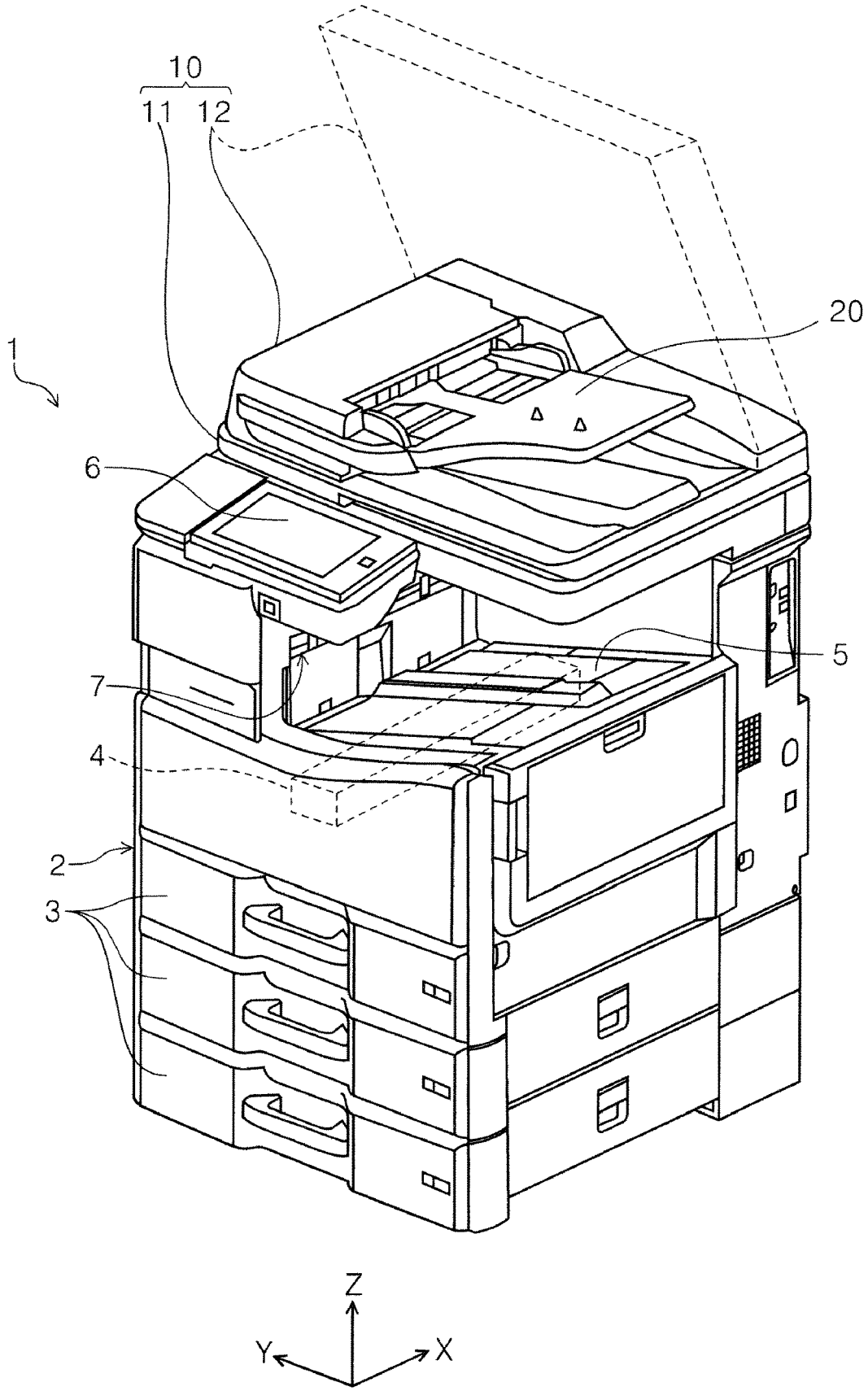
FIG. 1 is an external perspective view of a multifunction machine including a scanner provided with a medium feeding device according to an embodiment of the present disclosure.

Hereinafter, the present disclosure will be schematically described. A medium feeding device according to a first aspect of the present disclosure includes a medium mounting section on which a medium before feeding is mounted, a medium feeding mechanism switching between a first state in which the medium is fed from the medium mounting section and a second state in which the medium is not fed from the medium mounting section, a feeding roller rotationally driven in a forward rotation direction to feed the medium in a feeding direction, a separation roller that is configured to be rotationally driven in the forward rotation direction and in the reverse rotation direction opposite to the forward rotation direction, to which a predetermined rotational resistance is applied, and that is rotationally driven in the reverse rotation direction when the feeding roller is rotationally driven in the forward rotation direction to nip and separate the medium between the separation roller and the feeding roller, a motor driving the separation roller, and a cam member configured to switch between the first state and the second state of the medium feeding mechanism by power of the motor, wherein when the separation roller is rotationally driven in the forward rotation direction, the feeding roller is configured to be passively rotatable with respect to the separation roller, and wherein a rotation direction of the motor when the cam member switches the medium feeding mechanism from the first state to the second state is the same as a rotation direction of the motor when the separation roller rotates in the forward rotation direction.

In a case in which the feeding roller is stopped when the separation roller is rotationally driven in the reverse rotation direction and, a load is applied to the separation roller, and for example, a distortion may occur on the roller surface. According to this aspect, when the separation roller is rotationally driven in the forward rotation direction, the feeding roller is configured to be passively rotatable with respect to the separation roller, and wherein a rotation direction of the motor when the cam member switches the medium feeding mechanism from the first state to the second state is the same as a rotation direction of the motor when the separation roller rotates in the forward rotation direction, so that the following effects are obtained. That is, after a state in which the feeding roller is rotationally driven in the forward rotation direction is changed to a state in which the feeding roller is stopped, the separation roller is rotationally driven in the forward rotation direction, and the feeding roller is passively rotated with respect to the separation roller in accordance with the operation of switching the medium feeding mechanism from the first state to the second state, so that the distortion can be eliminated or reduced.

According to a second aspect of the present disclosure, the medium feeding device according to the first aspect includes, when a rotation direction of the motor when rotating the separation roller in the reverse rotation direction is defined as a first rotation direction, and a rotation direction of the motor when rotating the separation roller in the forward rotation direction is defined as a second rotation direction, a one-way clutch restricting a rotation of the cam member by power of the motor rotating in the first rotation direction.

According to this aspect, the medium feeding device includes a one-way clutch restricting a rotation of the cam member by power of the motor rotating in the first rotation direction, so that the cam member does not rotate when the motor rotates in the first rotation direction, and the cam member rotates only when the motor rotates in the second rotation direction. That is, the motor rotates the cam member only when the separation roller is rotated in the forward rotation direction, thereby being capable of switching between the first state and the second state of the medium feeding mechanism. When the motor rotates the separation roller in the reverse rotation direction, that is, when the feeding by the feeding roller is performed, the cam member does not rotate, so that the first state of the medium feeding mechanism is maintained when the medium is fed.

According to a third aspect of the present disclosure, in the medium feeding device according to the first aspect or the second aspect, the cam member includes a detected section rotating with the cam member, and a detector detecting the detected section is disposed to detect the detected section when the medium feeding mechanism is in the second state.

According to this aspect, the cam member includes a detected section rotating with the cam member, and a detector detecting the detected section is disposed to detect the detected section when the medium feeding mechanism is in the second state, so that the detector can detect the second state of the medium feeding mechanism. Therefore, the medium feeding mechanism can be easily returned to the second state even when the restriction section stops in the middle of pivoting due to, for example, a power failure or the like during the operation of the apparatus.

In addition, in the medium feeding device, when there is no unit that detects the second state of the medium feeding mechanism, an initialization operation for reliably setting the medium feeding mechanism to the second state is required, for example, when the device is activated or when the power saving mode is restored. However, by providing the detector, the initialization operation can be omitted when the detector detects the second state of the medium feeding mechanism, so that the time to onset of the medium can be shortened.

According to a fourth aspect of the present disclosure, the medium feeding device according to the third aspect citing the second aspect further includes a controller controlling an operation of the motor, wherein the controller operates the motor by a predetermined number of rotations in the second rotation direction starting from a state in which the detector detects the detected section prior to an operation of feeding the medium, wherein the operation is performed by the motor rotated in the first rotation direction.

According to this aspect, the controller operates the motor by a predetermined number of rotations in the second rotation direction starting from a state in which the detector detects the detected section prior to an operation of feeding the medium, wherein the operation is performed by the motor rotated in the first rotation direction, so that the cam member can be rotated to switch the medium feeding mechanism from the second state to the first state.

According to a fifth aspect of the present disclosure, in the medium feeding device according to the fourth aspect, the controller rotates the motor in the second rotation direction after the feeding operation is completed, and stops the motor when the detector detects the detected section.

According to this aspect, the controller rotates the motor in the second rotation direction after the feeding operation is completed, so that the cam member is rotated to switch the medium feeding mechanism from the first state to the second state. Then, the controller stops the motor when the detector detects the detected section, so that the rotation of the cam member can be stopped when the medium feeding mechanism is in the second state.

According to a sixth aspect of the present disclosure, in the medium feeding device according to the fourth aspect or the fifth aspect, the controller rotates the motor in the second rotation direction until the detector detects the detected section in a case where the detector does not detect the detected section when the device is activated or when an instruction of the feeding operation is input.

According to this aspect, the controller rotates the motor in the second rotation direction until the detector detects the detected section in a case where the detector does not detect the detected section when the device is activated or when an instruction of the feeding operation is input, so that the detector can be made to reliably detect the detected section before the feeding operation is started.

According to a seventh aspect of the present disclosure, in the medium feeding device according to any one of the first aspect to the sixth aspect, the medium feeding mechanism is located upstream of the feeding roller in the feeding direction, and includes a restriction section pivoting so as to allow a movement of the medium to the feeding direction in the first state, and restrict a movement of the medium to the feeding direction in the second state by an operation of the cam member.

According to this aspect, the medium feeding mechanism is located upstream of the feeding roller in the feeding direction, and includes a restriction section pivoting so as to allow a movement of the medium to the feeding direction in the first state, and restrict a movement of the medium to the feeding direction in the second state by an operation of the cam member, thereby being capable of switching between the first state and the second state of the medium feeding mechanism.

According to an eighth aspect of the present disclosure, in the medium feeding device according to the seventh aspect, the medium feeding mechanism is located upstream of the feeding roller in the feeding direction, configured to be displaceable between a contact state of coming into contact with the medium and a separation state of separating from the medium, and includes an upstream roller that draws out the medium toward the feeding roller by being rotationally driven in the contact state, and wherein the restriction section restricts a displacement of the upstream roller from the separation state to the contact state in the second state of the medium feeding mechanism.

According to this aspect, the medium feeding mechanism is located upstream of the feeding roller in the feeding direction, configured to be displaceable between a contact state of coming into contact with the medium and a separation state of separating from the medium, and includes an upstream roller that draws out the medium toward the feeding roller by being rotationally driven in the contact state, so that the medium can be fed toward the feeding roller, and the reliable feeding by the feeding roller can be implemented. Further, the restriction section restricts a displacement of the upstream roller from the separation state to the contact state in the second state of the medium feeding mechanism, so that it can be avoided that the upstream roller is in the contact state when the medium feeding mechanism is in the second state.

According to a ninth aspect of the present disclosure, the medium feeding device according to any one of the first aspect to the eighth aspect further includes a transport driving roller located downstream of the separation roller in the feeding direction and rotationally driven by power of the motor, and a transport driven roller passively rotated with respect to the transport driving roller, wherein the transport driving roller rotates in the forward rotation direction when the separation roller rotates in the reverse rotation direction, and rotates in the reverse rotation direction when the separation roller rotates in the forward rotation direction.

According to this aspect, the medium feeding device includes a transport driving roller located downstream of the separation roller in the feeding direction and rotationally driven by power of the motor, and a transport driven roller passively rotated with respect to the transport driving roller, wherein the transport driving roller rotates in the forward rotation direction when the separation roller rotates in the reverse rotation direction, and rotates in the reverse rotation direction when the separation roller rotates in the forward rotation direction, so that when the separation roller rotates in the reverse rotation direction, the feeding roller rotates in the forward rotation direction to feed the medium. At this time, the medium can be transported downstream by the transport driving roller and the transport driven roller.

In addition, when the separation roller rotates in the forward rotation direction, that is, when the cam member switches the first state and the second state of the medium feeding mechanism, the transport driving roller can be rotated in the reverse rotation direction. The switching between the first state and the second state of the medium feeding mechanism is performed in a state where the medium is not nipped by the pair of transport rollers, so that the possibility of damage to the medium can be avoided by the rotation of the transport driving roller to the reverse rotation direction.

An image reading apparatus according to a tenth aspect of the present disclosure includes a reading section that reads an image of the medium, and the medium feeding device according any one of the first aspect to the ninth aspect, wherein the medium feeding device feeds the medium toward the reading section.

According to this aspect, the image reading apparatus including a reading section that reads an image of the medium, and the medium feeding device that feeds the medium toward the reading section can provide effects similar to effects of the medium feeding device according to any one of the first aspect to the ninth aspect.

First Embodiment

A medium feeding device according to an embodiment of the present disclosure and an image reading apparatus including the medium feeding device will be described with reference to the drawings. A scanner 10 is taken as an example of the image reading apparatus. In the X-Y-Z coordinate system shown in each drawing, the X direction represents the width direction of the medium transported in the apparatus. The Y direction represents the transport direction of the medium. The Z direction represents the height direction of the apparatus. The −X direction is the direction from the rear side to the front side of the apparatus, and the +X direction is the opposite direction.

Outline of Scanner

Figure 2:
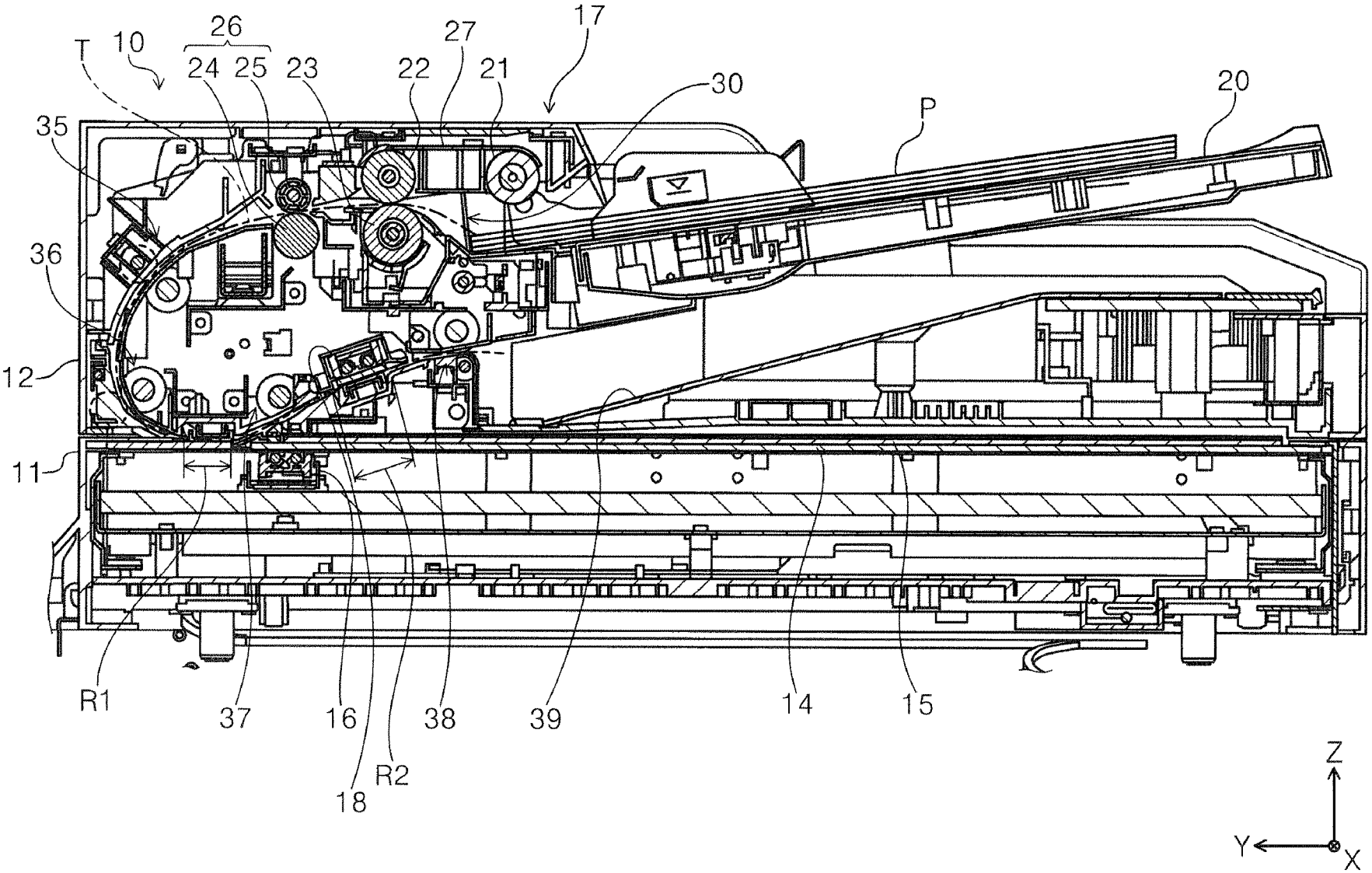
FIG. 2 is a side sectional view of the scanner shown in FIG. 1.

As shown in FIG. 1, the scanner 10 is provided above a recording section 2 and constitutes a multifunction machine 1 having both the recording function and the image reading function. As shown in FIG. 2, the scanner 10 includes a scanner main body 11 having a reading section 16 capable of reading a document set on a document tray 14, and a medium feeding device 12 that feed a medium P as a document mounted on a feeding tray 20 to the reading section 16.

The medium feeding device 12 is configured to be switchable between the closed posture of the scanner main body 11 with respect to the document tray 14 in FIG. 2 as shown by the solid line in FIG. 1, and the open posture of the scanner main body 11 with respect to the document tray 14. More specifically, the medium feeding device 12 is coupled to the scanner main body 11 so as to be able to open and close with the −X side of the scanner main body 11 as a pivot.

Further, an operation section 6 is provided on the front of the multifunction machine 1. The operation section 6 is provided with a display such as a liquid crystal panel. Further, it is possible to input an instruction of the recording operation in the recording section 2 and the image reading operation in the scanner 10 to the multifunction machine 1 through the operation of the operation section 6.

The recording section 2 of the multifunction machine 1 has a plurality of sheet storage cassettes 3 for storing recording sheets at its lower part. A recording section 4 that performs recording on a medium to be transported is provided inside the recording section 2, and the recording on the sheet transported from the sheet storage cassette 3 is performed. The sheet after recording is discharged from a discharge section 7 and mounted on a recording section discharge tray 5. In the multifunction machine 1, the discharge section 7 and the recording section discharge tray 5 are provided between the scanner 10 and the sheet storage cassette 3 in the Z-axis direction which is the height direction of the apparatus.

In FIG. 2, an optical reading section such as a CIS method or a CCD method is used for the reading section 16 provided in the scanner main body 11. The reading section 16 is provided below the document tray 14, configured to be movable in the Y-axis direction, and can read the medium mounted on the document tray 14. The document tray 14 is formed of colorless and transparent glass as an example.

A presser plate 15 is provided to hold the medium mounted on the document tray 14 on the lower surface of the medium feeding device 12 shown in FIG. 2. When the medium feeding device 12 is opened, the document tray 14 is exposed. It is possible to read the medium by moving the reading section 16 in the Y-axis direction while the medium is mounted on the document tray 14 and the medium feeding device 12 is closed and the medium is pressed by the presser plate 15. The scanner 10 can read not only the medium mounted on the document tray 14 but also the medium transported by the medium feeding device 12.

About Medium Feeding Device

The medium feeding device 12 will be described with reference to FIGS. 2 to 5. In FIG. 2, a dot-and-dash line illustrated by a reference sign T indicates a medium transport path in the medium feeding device 12. The medium transport path T is a path from the pickup position by a pick roller 21 to be described later to a discharge tray 39.

The medium P transported by the medium feeding device 12 is mounted on the feeding tray 20 as shown in FIG. 2. That is, the feeding tray 20 is a "medium mounting section" on which the medium before feeding is mounted. The medium feeding device 12 has a medium feeding mechanism 17 that switches between a first state in which the medium P is fed out of the feeding tray 20 as shown in FIG. 4, and a second state in which the medium P is not fed out of the feeding tray 20 as shown in FIG. 3.

The medium feeding mechanism 17 includes the pick roller 21 as an "upstream roller" and a restriction section 30. The pick roller 21 is provided on the +Y side of the medium P mounted on the feeding tray 20, that is, at a position facing the leading end of the medium P in the feeding direction. A feeding roller 22 is provided on the +Y side, that is, downstream of the pick roller 21 in the feeding direction. In other words, the pick roller 21 is located upstream of the feeding roller 22 in the feeding direction.

Figure 3:
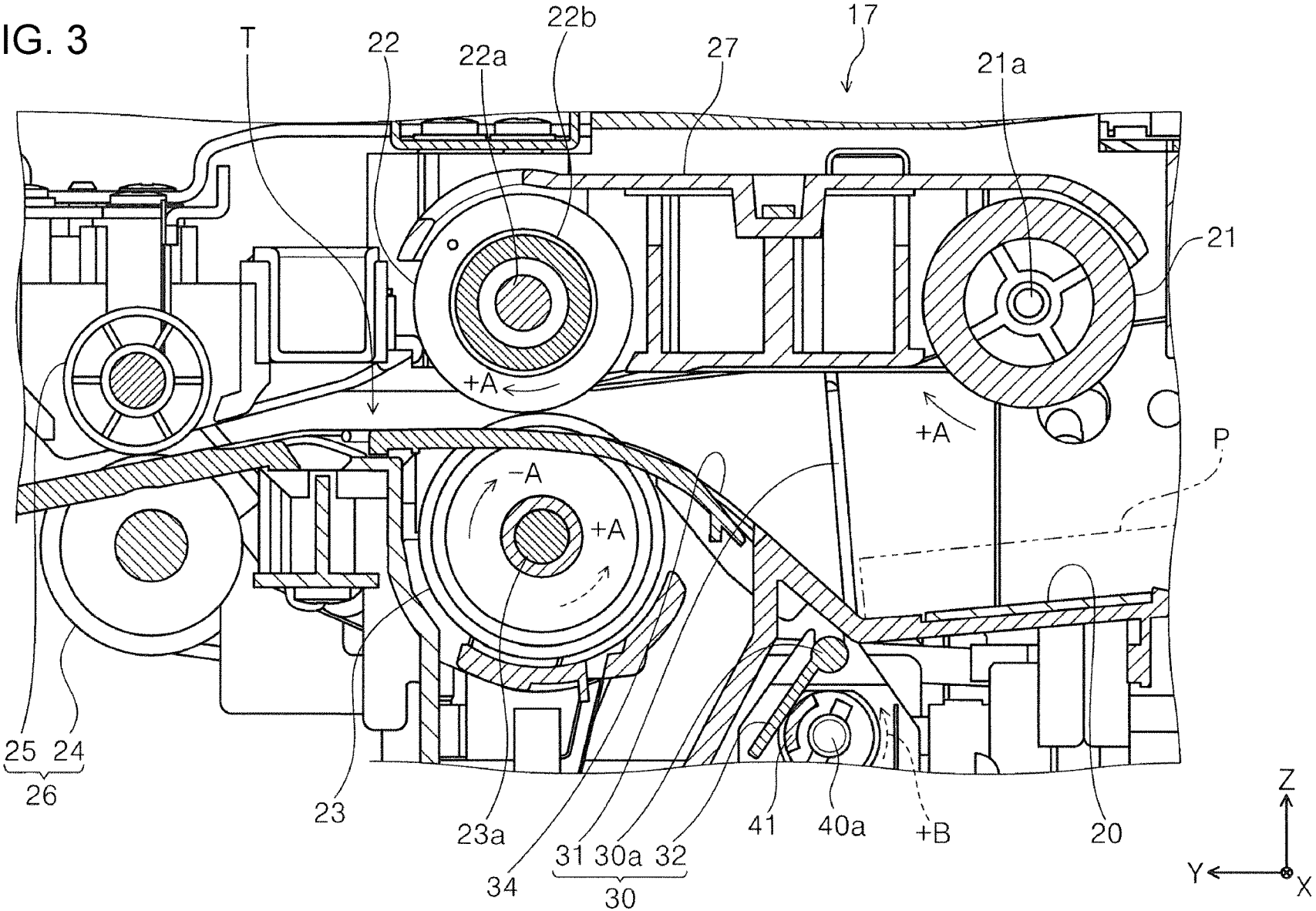
FIG. 3 is a diagram showing a second state of a medium feeding mechanism.
Figure 4:
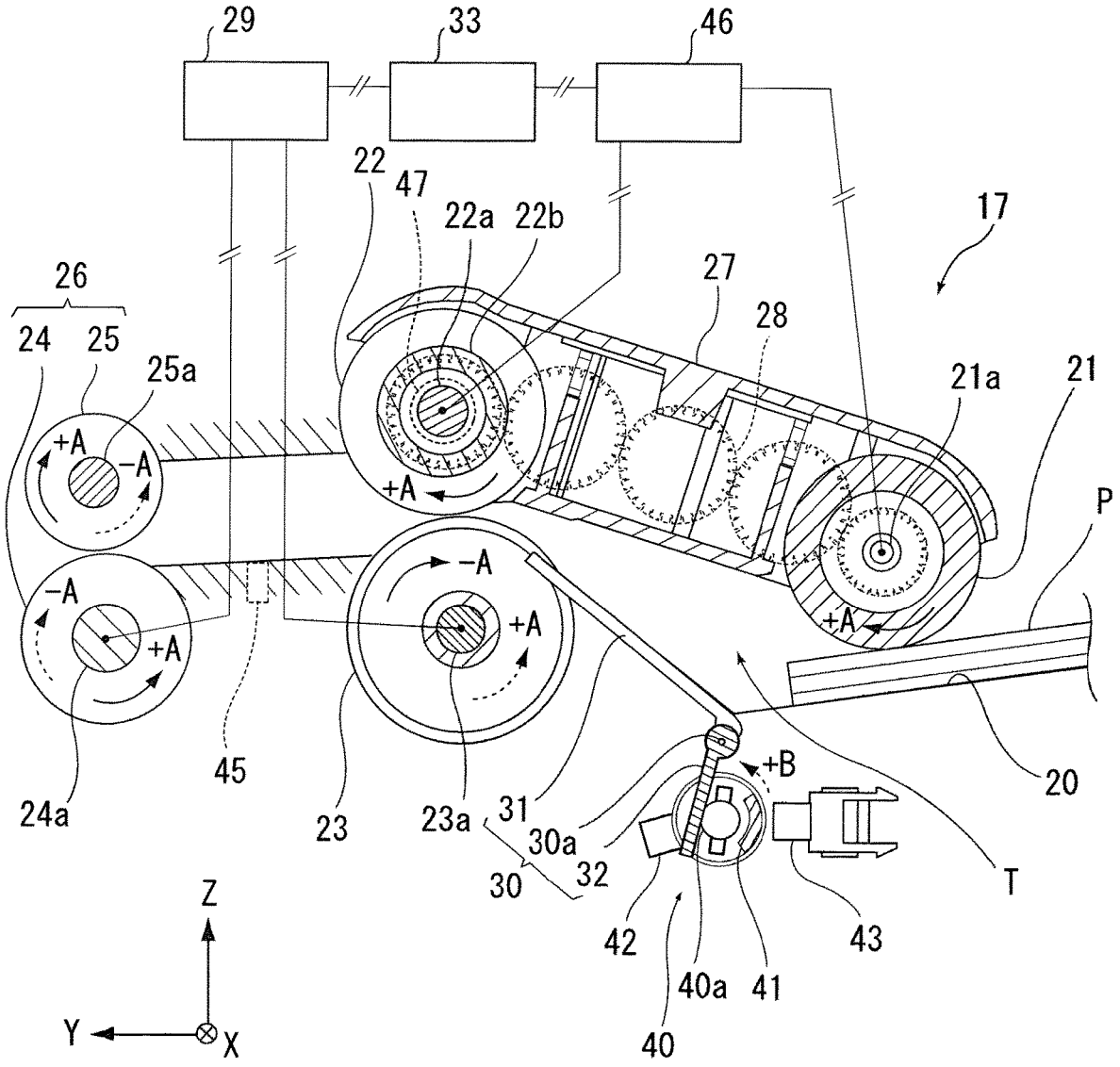
FIG. 4 is a diagram showing a first state of a medium feeding mechanism.

The pick roller 21 is configured to be displaceable between a contact state of coming into contact with the medium P as shown in FIG. 4 and a separation state of separating from the medium P as shown in FIG. 3, and draws out the medium P toward the feeding roller 22 by being rotationally driven in the contact state. That is, the pick roller 21 picks up the medium P mounted on the feeding tray 20 and feeds it to the medium transport path T in the contact state shown in FIG. 4. The medium P can be fed toward the feeding roller 22 by the pick roller 21, and feeding by the feeding roller 22 can be implemented.

The pick roller 21 shown in FIG. 4 is attached to a holder 27 which swings with respect to a swing shaft 22*b* coaxial with a rotation shaft 22*a* of the feeding roller 22. The pick roller 21 receives power from a second motor 46 shown in FIG. 4 and is rotationally driven about a rotation shaft 21*a*. The second motor 46 is also a power source that rotationally drives the feeding roller 22. The power of the second motor 46 is transmitted to the feeding roller 22 by a power transmitter (not shown) and is further transmitted to the pick roller 21 via a power transmitter 28. A one-way clutch 47 for the feeding roller is provided on the rotation shaft 22*a* of the feeding roller 22, and is configured to be rotatable only in the forward rotation direction +A. The feeding roller 22 can also be configured to be rotationally driven by a first motor 29 to be described later. In this case, the power transmission from the first motor 29 to the feeding roller 22 can be switched on and off by switching the clutch between on and off.

The restriction section 30 is provided below the holder 27. The restriction section 30 restricts the displacement of the pick roller 21 from the separation state to the contact state in FIG. 4 in the second state of the medium feeding mechanism 17 shown in FIG. 3. With this configuration, it can be avoided that the pick roller 21 is in the contact state when the medium feeding mechanism 17 is in the second state. The operation of the restriction section 30 will be described later.

In FIG. 4, the feeding roller 22 is rotationally driven in the forward rotation direction +A so as to feeds the medium P in the +Y direction, which is the feeding direction, and feeds the medium P picked up by the pick roller 21 in the +Y direction. The forward rotation direction +A of the feeding roller 22 is a clockwise direction in a plan view with respect to FIG. 4.

A separation roller 23 is disposed on the −Z side, that is, below the feeding roller 22. The separation roller 23 is configured to be rotationally driven in the forward rotation direction +A to feed the medium P in the +Y direction in FIG. 4 and in the reverse rotation direction −A opposite to the forward rotation direction +A, and a predetermined rotational resistance is applied to the separation roller 23 by a torque limiter 64 shown in FIG. 5. The separation roller 23 is rotationally driven in the reverse rotation direction −A when the feeding roller 22 is rotationally driven in the forward rotation direction +A, and nips and separates the medium P between the separation roller 23 and the feeding roller 22.

The forward rotation direction +A of the separation roller 23 represents a counterclockwise direction in a plan view with respect to FIG. 4, and the reverse rotation direction −A represents a clockwise direction in a plan view with respect to FIG. 4. The "motor" that rotationally drives the separation roller 23 is the first motor 29. That is, the separation roller 23 receives power from the first motor 29 and rotates. The first motor 29 is also a power source for rotationally driving a transport driving roller 24 and a cam member 40, which will be described later, in addition to the separation roller 23. The scanner 10 includes a controller 33 that controls the operation of the first motor 29. The controller 33 can control various operations of the second motor 46 and the scanner 10 in addition to the first motor 29. A power transmission mechanism 50 from the first motor 29 to each member will be described later.

Further, when the separation roller 23 is rotationally driven in the forward rotation direction +A, the feeding roller 22 is configured to be passively rotatable in the forward rotation direction +A with respect to the separation roller 23. The separation roller 23 is formed of an elastic resin material having a high coefficient of friction, rubber or the like.

The restriction section 30 constituting the medium feeding mechanism 17 is disposed on the −Y side, that is, upstream of the feeding roller 22 in the feeding direction. The restriction section 30 switches, by pivoting around a pivot shaft 30*a* as a pivot, between the feeding state in which the movement of the medium P to the feeding direction is allowed as shown in FIG. 4, and the restriction state in which the movement of the medium P to the feeding direction is restricted as shown in FIG. 3. The restriction section 30 is in the feeding state in the first state of the medium feeding mechanism 17, and the restriction section 30 is in the restriction state in the second state of the medium feeding mechanism 17. In other words, the restriction section 30 allows the movement of the medium P to the feeding direction, that is, the +Y direction, in the first state shown in FIG. 4 and pivots so as to restrict the movement of the medium P to the feeding direction in the second state shown in FIG. 3.

Figure 5:
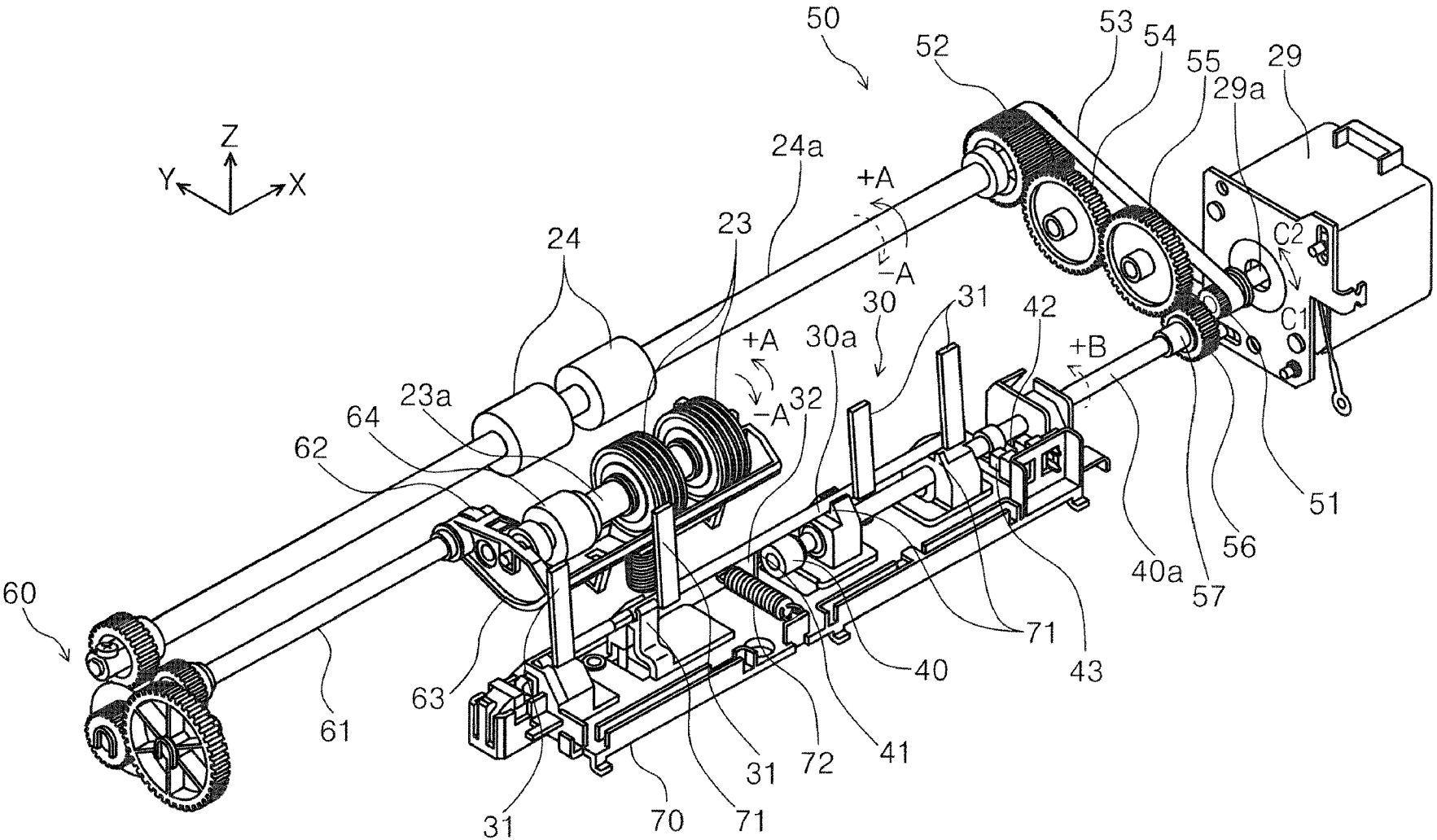
FIG. 5 is a perspective view of a power transmission mechanism from a first motor.

More specifically, as shown in FIG. 5, the restriction section 30 is provided with a plate-like stopper portion 31 provided at intervals in the width direction, and pivots about the pivot shaft 30*a* between the restriction state in which the stopper portion 31 projects against the medium transport path T as shown in FIG. 3 to restrict the movement of the medium P to the +Y direction, and the feeding state in which the stopper portion 31 retracts from the medium transport path T as shown in FIG. 4 to allow the movement of the medium P to the +Y direction. In FIG. 5, reference numeral 70 denotes a support 70 that supports the restriction section 30, and the support 70 is provided with a bearing 71. Moreover, in FIG. 4 and FIG. 5, the restriction section 30 is provided with a contacted portion 32 to which a contact portion 41 of the cam member 40 to be described later contacts.

Switching between the first state and the second state of the medium feeding mechanism 17, that is, switching between the feeding state and the restriction state of the restriction section 30 is performed by causing the restriction section 30 to pivot by the rotation of the cam member 40. The cam member 40 is rotated in the +B direction shown in FIGS. 3 and 4 by the power of the first motor 29, and switches between the first state in FIG. 4 and the second state in FIG. 3 of the medium feeding mechanism 17. The power from the first motor 29 is transmitted to the cam member 40 by the power transmission mechanism 50 to be described later.

The cam member 40 shown in FIGS. 3 to 5 is provided with the contact portion 41. As shown in FIG. 3, when the contact portion 41 of the cam member 40 is away from the contacted portion 32 of the restriction section 30, the restriction section 30 is pressed so as to be in the feeding state by a spring 72 shown in FIG. 5. The spring 72 is a tension spring having one end attached to the restriction section 30 and the other end attached to the support 70.

When the cam member 40 rotates in the +B direction from the state shown in FIG. 3, the contact portion 41 comes into contact with the contacted portion 32 as shown in FIG. 4, and causes the contacted portion 32 to pivot against the pressing force of the spring 72 clockwise in a plan view with respect to FIGS. 3 and 4. As a result, the stopper portion 31 also rotates clockwise, and as shown in FIG. 3, the restriction section 30 is in the restriction state. The restriction section 30 can easily switch between the first state and the second state of the medium feeding mechanism 17.

Further, in FIGS. 2 and 4, there is provided a pair of first transport rollers 26 downstream of the separation roller 23 in the feeding direction which includes the transport driving roller 24 that is rotationally driven by the power of the first motor 29 in FIG. 4, and a transport driven roller 25 that is passively rotated with respect to the transport driving roller 24. As shown in FIG. 4, the transport driving roller 24 rotates in the forward rotation direction +A when the separation roller 23 rotates in the reverse rotation direction −A, and Rotates in the reverse rotation direction −A when the separation roller 23 rotates in the forward rotation direction +A. For the transport driving roller 24, the forward rotation direction +A represents a counterclockwise direction in a plan view with respect to FIG. 4, and the reverse rotation direction −A represents a clockwise direction in a plan view with respect to FIG. 4.

That is, when the separation roller 23 rotates in the reverse rotation direction −A, the feeding roller 22 rotates in the forward rotation direction +A to feed the medium P. At this time, the medium P can be transported downstream by the transport driving roller 24 and the transport driven roller 25. When the transport driving roller 24 rotates in the forward rotation direction +A, the transport driven roller 25 rotates in the forward rotation direction +A clockwise in a plan view with respect to FIG. 4. A medium detector 45 that detects the medium P is provided downstream of the separation roller 23 and upstream of the transport driving roller 24 in the feeding direction.

Figure 6:
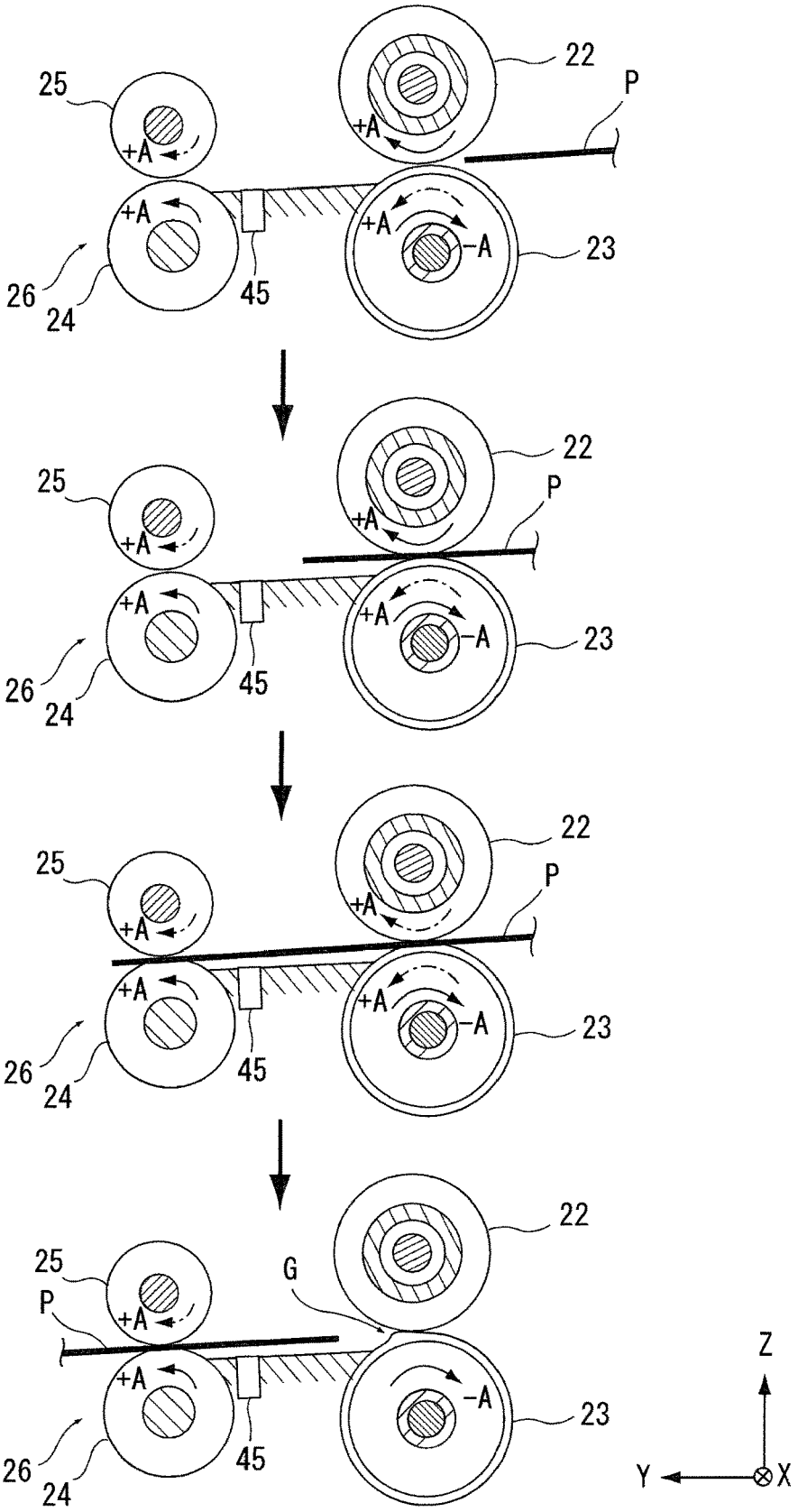
FIG. 6 is a diagram of illustrating the feeding of the medium by the medium feeding device.

Here, with reference to FIG. 6, the operation of the feeding roller 22 and the separation roller 23 when one medium P is fed will be described. In FIG. 6, the driving rotation direction of each roller is indicated by an arrow of the solid line, and the driven rotation direction is indicated by an arrow of the dot-and-dash line. When the feeding operation for feeding the medium P is started, the medium P is fed to the feeding roller 22 and the separation roller 23 by the pick roller 21 (not shown in FIG. 6) as shown in the figure of the top of FIG. 6.

At the time of feeding the medium P, the feeding roller 22 is rotationally driven in the forward rotation direction +A, and the separation roller 23 is rotationally driven in the reverse rotation direction −A. The predetermined rotational resistance M is applied to the separation roller 23 by the torque limiter 64 shown in FIG. 5, and the frictional resistance M1 between the feeding roller 22, and the separation roller 23 is set to be larger than the rotational resistance M by the torque limiter 64. Therefore, in a state where there is no medium P between the feeding roller 22 and the separation roller 23, the separation roller 23 is separated from the drive system of the first motor 29 by the function of the torque limiter 64 and is passively rotated by the feeding roller 22 in the forward rotation direction +A.

As shown in the second figure from the top of FIG. 6, the medium P is nipped between the feeding roller 22 and the separation roller 23 and fed in the +Y direction. Since the frictional resistance M2 between the medium P and the separation roller 23 at this time is also larger than the rotational resistance M by the torque limiter 64, the separation roller 23 is separated from the drive system of the first motor 29 by the function of the torque limiter 64, and rotates in the forward rotation direction +A so as to feed the medium P in the feeding direction.

The feeding roller 22 is rotationally driven in the forward rotation direction +A until the leading end of the medium P is nipped by the pair of first transport rollers 26 to feed the medium P in the +Y direction. As shown in the second figure from the bottom of FIG. 6, when the medium P is nipped by the pair of first transport rollers 26, the medium P is subsequently fed in the +Y direction by the driving force of the transport driving roller 24, so that the rotational drive of the feeding roller 22 is stopped. The separation roller 23 is still rotationally driven in the reverse rotation direction −A. Even when the rotational drive of the feeding roller 22 is stopped, the feeding roller 22 and the separation roller 23 are pulled by the medium P and rotate in the forward rotation direction +A.

When the medium P is fed in the +Y direction by the pair of first transport rollers 26 and the rear end of the medium P is away from the nip by the feeding roller 22 and the separation roller 23 as shown in the figure of the bottom of FIG. 6, the rotation of the feeding roller 22 whose driving has been stopped is stopped. Although the separation roller 23 is rotationally driven in the reverse rotation direction −A, as described above, the frictional resistance M1 between the feeding roller 22 and the separation roller 23 is larger than the rotational resistance M by the torque limiter 64, so that the rotation of the separation roller 23 is also stopped.

As described above, in a state in which the driving of the feeding roller 22 and the rotation thereof are stopped, when the separation roller 23 is rotationally driven in the reverse rotation direction −A, and the rotation is stopped due to the frictional resistance M1 between the feeding roller 22 and the separation roller 23, a load is applied to the separation roller 23, so that a distortion G may occur on the roller surface. The distortion G on the roller surface can be eliminated or reduced by rotating the separation roller 23 in a direction opposite the reverse rotation direction −A, that is, in the forward rotation direction +A. When the separation roller 23 is rotationally driven in the forward rotation direction +A, the feeding roller 22 is configured to be passively rotatable with respect to the separation roller 23.

When two or more media P are pinched between the feeding roller 22 and the separation roller 23, the separation roller 23 is coupled to the drive system of the first motor 29 by the function of the torque limiter 64, and rotate in the reverse rotation direction −A, thereby preventing the medium other than the medium in contact with the feeding roller 22 from being fed out in the feeding direction. Thus, the media P mounted on the feeding tray 20 can be fed out to the medium transport path T while being separated into one medium.

The medium transport path T shown in FIG. 2 is curved downstream of the pair of first transport rollers 26. The medium P is curved and inverted while being fed through the medium transport path T by a pair of second transport rollers 35 and a pair of third transport rollers 36 provided downstream of the pair of first transport rollers 26, and fed to a reading region R1 in the medium transport path T. The reading region R1 of the medium transport path T is formed of a colorless transparent member such as glass wherein the reading region R1 faces the scanner main body 11, and when the medium P passes the reading region R1, the lower surface of the medium P in the reading region R1 is read by the reading section 16 of the scanner main body 11.

In FIG. 2, the reading section 16 is at a position shifted from the reading region R1 in the Y-axis direction, but when reading the medium P transported by the medium feeding device 12, the reading section 16 moves to a position corresponding to the reading region R1. Further, in the present embodiment, the medium transport path T is formed as a path for bending and inverting the medium, but the path may be formed so as to transport the medium toward the reading section 16 and the upper reading section 18 without inverting the medium from the feeding tray 20 to the discharge tray 39.

The upper reading section 18 is provided downstream of the reading region R1 in the medium transport path T. The upper reading section 18 is provided at the upper portion of the medium transport path T. The medium P read by the reading section 16 is transported by a pair of fourth transport rollers 37 toward the upper reading section 18. When the medium P passes through the reading region R2 corresponding to the upper reading section 18, the upper reading section 18 reads the upper surface of the medium P in the reading region R2. The reading section 16 and the upper reading section 18 can read both surfaces of the medium P.

The medium P read by the upper reading section 18 is discharged to the discharge tray 39 by a pair of discharge rollers 38. The discharge tray 39 is configured to receive the medium P discharged by the discharge roller pair 38 in an inclined posture. In the present embodiment, the medium transport path T is formed as a path for bending and inverting the medium, but the medium transport path T may be a straight path so as to transport the medium P toward the reading section 16 without inverting the medium P from the feeding tray 20 to the discharge tray 39.

About Power Transmission Mechanism

The power transmission mechanism 50 shown in FIG. 5 will be described. The first motor 29 has a rotation shaft 29*a* that rotates, and is provided with a first gear 51 at the distal end of the rotation shaft 29*a*. Further, a second gear 52 is provided at the +X side end of a rotation shaft 24*a* of the transport driving roller 24. An endless belt 53 is wound around the first gear 51 and the second gear 52. The rotational force of the first gear 51 is transmitted to the second gear 52, and the transport driving roller 24 is rotated.

A first gear group 60 is provided on the −X side of the rotation shaft 24*a*, and the rotation of the rotation shaft 24*a* is transmitted to a shaft portion 61 via the first gear group 60. Furthermore, the rotation of the shaft portion 61 is transmitted to a rotation shaft 23*a* of the separation roller 23 via a second gear group 62. The torque limiter 64 is provided on the rotation shaft 23*a*, and a predetermined rotational resistance is applied to the separation roller 23.

Next, transmission of power to the cam member 40 will be described. A fifth gear 56 is provided at the +X side end of a rotating shaft 40*a* of the cam member 40. The rotational force transmitted to the second gear 52 described above is transmitted to the fifth gear 56 via a third gear 54 and a fourth gear 55.

Here, in FIG. 5, the rotation direction of the first motor 29 when the separation roller 23 is rotated in the reverse rotation direction −A is defined as the first rotation direction C1, and the rotation direction of the first motor 29 when the separation roller 23 is rotated in the forward rotation direction +A is defined as the second rotation direction C2. When the first motor 29 is rotated in the first rotation direction C1, the separation roller 23 is rotated in the reverse rotation direction −A, and the transport driving roller 24 is rotated in the forward rotation direction +A. That is, the first rotation direction C1 of the first motor 29 is the rotation direction when the medium P is fed.

The power transmission mechanism 50 is provided with a one-way clutch 57 that restricts a rotation of the cam member 40 by the power of the first motor 29 rotating in the first rotation direction C1. In the present embodiment, the one-way clutch 57 is provided to the fifth gear 56. Therefore, when the first motor 29 rotates in the first rotation direction C1, the cam member 40 does not rotate. As a result, since the cam member 40 does not rotate when the feeding by the feeding roller 22 is performed, the first state in FIG. 4 of the medium feeding mechanism 17 can be maintained when the medium P is fed.

On the other hand, when the first motor 29 is rotated in the second rotation direction C2, the separation roller 23 rotates in the forward rotation direction +A, and the transport driving roller 24 rotates in the reverse rotation direction −A. The second rotation direction C2 of the first motor 29 is a rotation direction opposite to the rotation direction when the medium P is fed. Further, the cam member 40 can be rotated in the +B direction in FIG. 5 to switch between the first state and the second state of the medium feeding mechanism 17.

That is, the medium feeding device 12 of the present embodiment is configured such that the rotation direction of the first motor 29 when the cam member 40 switches the medium feeding mechanism 17 from the first state to the second state is the same as the rotation direction of the first motor 29 when the separation roller 23 rotates in the forward rotation direction +A.

As described above with reference to FIG. 6, when the rear end of the fed medium P is away from the nip between the feeding roller 22 and the separation roller 23, the separation roller 23 may have the distortion G shown in the figure of the bottom of FIG. 6. The distortion G can be eliminated or reduced by rotating the separation roller 23 in the forward rotation direction +A. The distortion G of the separation roller 23 remains after the feeding of the medium P by the feeding roller 22. When the feeding operation is completed, switching between the first state in FIG. 4 to the second state in FIG. 3 of the medium feeding mechanism 17 is performed. Since the rotation direction of the first motor 29 at the time of switching the state of the medium feeding mechanism 17 is the same as the rotation direction of the first motor 29 at the time of eliminating the distortion G of the separation roller 23, the distortion G of the separation roller 23 can be eliminated or reduced in accordance with the operation of the medium feeding mechanism 17 from the first state to the second state when the feeding operation is completed.

About Detector

In FIGS. 3 to 5, the cam member 40 includes a detected section 42 which rotates with the cam member 40. As shown in FIG. 5, the detected section 42 is provided at a position away from the cam member 40 in the X-axis direction with respect to the rotating shaft 40*a* of the cam member 40, and rotates integrally with the cam member 40.

A detector 43 that detects the detected section 42 is disposed to detect the detected section 42 when the medium feeding mechanism 17 is in the second state as illustrated in FIG. 3, that is, when the restriction section 30 is in the restriction state. Thus, the detector 43 can detect the second state of the medium feeding mechanism 17. As an example, an optical sensor such as a photo interrupter can be used for the detector 43. Since the second state of the medium feeding mechanism 17 can be detected by the detector 43, the medium feeding mechanism 17 can be easily returned to the second state even when the restriction section 30 stops in the middle of pivoting due to, for example, a power failure occurring during the operation of the apparatus.

About Control by Controller

Figure 7:
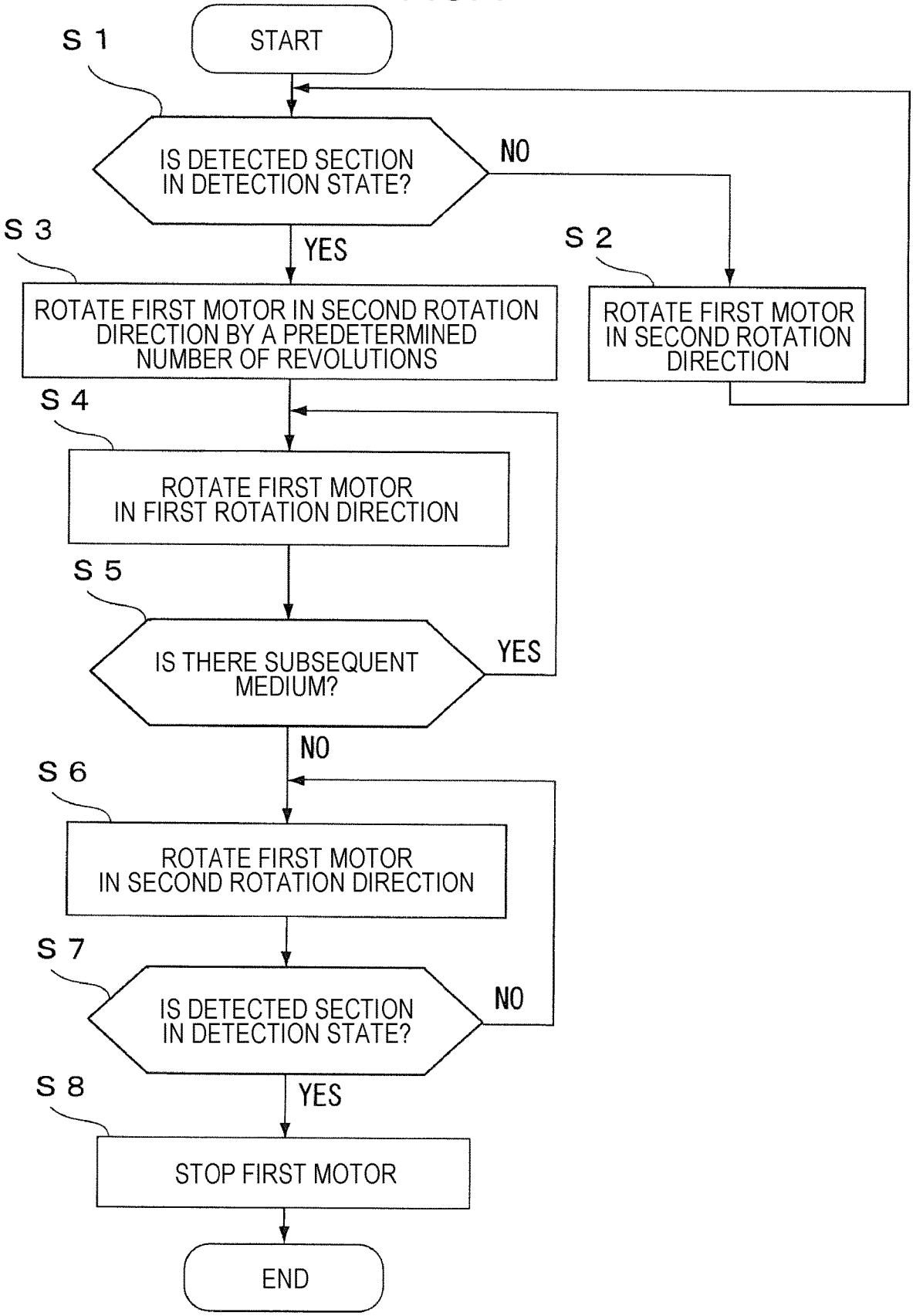
FIG. 7 is a flowchart illustrating control of a first motor by a controller.

Control of the first motor 29 by the controller 33 when feeding the medium P will be described with reference to the flowchart shown in FIG. 7. First, in a case where the detector 43 does not detect the detected section 42 when an instruction for the feeding operation is input to the scanner 10, the controller 33 causes the first motor 29 to rotate in the second rotation direction C2 in FIG. 5 until the detector 43 detects the detected section 42. More specifically, it is determined in step S1 whether the detected section 42 is detected by the detector 43, and when the determination is "NO" in step S1, that is, when the detected section 42 is not detected by the detector 43, the first motor 29 is rotated in the second rotation direction C2 in FIG. 5 in step S2.

After performing step S2, the process returns to step S1, and steps S1 and S2 are repeated until the determination is "YES" in step S1, that is, the detector 43 detects the detected section 42. As a result, before the start of the feeding operation in the scanner 10, the detector 43 can be made to reliably detect the detected section 42. Step S1 can also be performed when the scanner 10 is started.

When the determination is "YES" in step S1, that is, when the detector 43 detects the detected section 42, step S3 is performed in which the controller 33 operates the first motor 29 by a predetermined number of rotations in the second rotation direction C2 prior to the operation of feeding the medium P performed by the first motor 29 rotated in the first rotation direction C1 in FIG. 5. In the state in which the detector 43 detects the detected section 42, as illustrated in FIG. 3, the restriction section 30 is in the restriction state, and the medium feeding mechanism 17 is in the second state. It is possible to switch the restriction section 30 from the restriction state in FIG. 3 to the feeding state in FIG. 4 by rotating the cam member 40 by the predetermined rotation amount by operating the first motor 29 in the second rotation direction C2 by the predetermined number of rotations starting from the second state of the medium feeding mechanism 17 in which the detector 43 detects the detected section 42. Thus, it is possible to switch the medium feeding mechanism 17 from the second state in FIG. 3 to the first state in FIG. 4.

When the medium feeding mechanism 17 is in the first state in FIG. 4, the controller 33 performs step S4 in which the first motor 29 is rotated in the first rotation direction C1 in FIG. 5, that is, the rotation direction during feeding. Simultaneously with step S4, the controller 33 controls the second motor 46 to rotate the feeding roller 22 in the forward rotation direction +A to feed the medium P.

When the preceding medium that has been previously fed is fed, it is determined in step S5 whether there is a subsequent medium. The presence or absence of the subsequent medium may be determined, for example, by whether the leading end of the subsequent medium is detected by the medium detector 45 shown in FIG. 4 within a predetermined time after the rear end of the preceding medium is detected. When the determination is "YES" in step S5, that is, when there is a subsequent medium, the process returns to step S4 to continue the medium feeding. When the determination is "NO" in step S5, that is, when there is no subsequent medium, the feeding operation is regarded as completed, and the process proceeds to step S6.

In step S6, the controller 33 rotates the first motor 29 in the second rotation direction C2 in FIG. 5 after the completion of the feeding operation. By rotating the first motor 29 in the second rotation direction C2, it is possible to switch the medium feeding mechanism 17 from the first state to the second state. Further, as shown in the lowermost figure of FIG. 6, it is possible to eliminate or reduce the distortion G of the roller surface of the separation roller 23, which occurs when the rear end of the medium P passes through the nip between the feeding roller 22 and the separation roller 23.

In step S7, the detector 43 determines whether to detect the detected section 42, and the first motor 29 is rotated in the second rotation direction C2 until the detector 43 detects the detected section 42. That is, when the determination is "NO" in step S7, that is, when the detector 43 does not detect the detected section 42, the process returns to step S6, and the first motor 29 is rotated in the second rotation direction C2. When the determination is "YES" in step S7, that is, when the detector 43 detects the detected section 42, the process proceeds to step S8, and the first motor 29 is stopped. Since the first motor 29 is stopped when the detector 43 detects the detected section 42 after the medium feeding is completed, the first motor 29 can be stopped when the medium feeding mechanism 17 is in the second state shown in FIG. 3, and the cam member 40 can be stopped. Thus, the subsequent feeding can be smoothly performed.

The present disclosure is not limited to the embodiments described above, and various modifications are possible within the scope of the present disclosure described in the claims, and they are also included in the scope of the present disclosure.

What is claimed is:

1. A medium feeding device comprising:

a medium mounting section on which a medium before feeding is mounted;

a medium feeding mechanism switching between a first state in which the medium is fed from the medium mounting section and a second state in which the medium is not fed from the medium mounting section;

a feeding roller rotationally driven in a forward rotation direction to feed the medium in a feeding direction;

a separation roller that is configured to be rotationally driven in the forward rotation direction and in the reverse rotation direction opposite to the forward rotation direction, to which a predetermined rotational resistance is applied, and that is rotationally driven in the reverse rotation direction when the feeding roller is rotationally driven in the forward rotation direction to nip and separate the medium between the separation roller and the feeding roller;

a motor driving the separation roller;

a transport driving roller located downstream of the separation roller in the feeding direction and rotationally driven by power of the motor;

a transport driven roller passively rotated with respect to the transport driving roller; and a cam member configured to switch between the first state and the second state of the medium feeding mechanism by power of the motor, wherein when the separation roller is rotationally driven in the forward rotation direction, the feeding roller is configured to be passively rotatable with respect to the separation roller, wherein a rotation direction of the motor when the cam member switches the medium feeding mechanism from the first state to the second state is the same as a rotation direction of the motor when the separation roller rotates in the forward rotation direction, and wherein the transport driving roller rotates in the forward rotation direction when the separation roller rotates in the reverse rotation direction, and rotates in the reverse rotation direction when the separation roller rotates in the forward rotation direction.

2. The medium feeding device according to claim 1, further comprising:

when a rotation direction of the motor when rotating the separation roller in the reverse rotation direction is defined as a first rotation direction, and a rotation direction of the motor when rotating the separation roller in the forward rotation direction is defined as a second rotation direction, a one-way clutch restricting a rotation of the cam member by power of the motor rotating in the first rotation direction.

3. The medium feeding device according to claim 2, wherein the cam member comprises a detected section rotating with the cam member, and wherein a detector detecting the detected section is disposed to detect the detected section when the medium feeding mechanism is in the second state.

4. The medium feeding device according to claim 3, further comprising:

a controller controlling an operation of the motor, wherein the controller operates the motor by a predetermined number of rotations in the second rotation direction starting from a state in which the detector detects the detected section prior to an operation of feeding the medium, the operation being performed by the motor rotated in the first rotation direction.

5. The medium feeding device according to claim 4, wherein the controller rotates the motor in the second rotation direction after the feeding operation is completed, and stops the motor when the detector detects the detected section.

6. The medium feeding device according to claim 4, wherein the controller rotates the motor in the second rotation direction until the detector detects the detected section in a case in which the detector does not detect the detected section when the device is activated or when an instruction of the feeding operation is input.

7. The medium feeding device according claim 1, wherein the medium feeding mechanism is located upstream of the feeding roller in the feeding direction, and includes a restriction section pivoting so as to allow a movement of the medium to the feeding direction in the first state, and regulate a movement of the medium to the feeding direction in the second state by an operation of the cam member.

8. The medium feeding device according to claim 7, wherein the medium feeding mechanism is located upstream of the feeding roller in the feeding direction, configured to be displaceable between a contact state of coming into contact with the medium and a separation state of separating from the medium, and includes an upstream roller that draws out the medium toward the feeding roller by being rotationally driven in the contact state, and wherein the restriction section restricts a displacement of the upstream roller from the separation state to the contact state in the second state of the medium feeding mechanism.

9. An image reading apparatus comprising:

a reading section that reads an image of the medium; and the medium feeding device according claim 1 that feeds the medium toward the reading section.

10. A medium feeding device comprising:

a medium mounting section on which a medium before feeding is mounted;

a medium feeding mechanism switching between a first state in which the medium is fed from the medium mounting section and a second state in which the medium is not fed from the medium mounting section;

a feeding roller rotationally driven in a forward rotation direction to feed the medium in a feeding direction;

a separation roller that is configured to be rotationally driven in the forward rotation direction and in the reverse rotation direction opposite to the forward rotation direction, to which a predetermined rotational resistance is applied, and that is rotationally driven in the reverse rotation direction when the feeding roller is rotationally driven in the forward rotation direction to nip and separate the medium between the separation roller and the feeding roller;

a motor driving the separation roller;

a cam member configured to switch between the first state and the second state of the medium feeding mechanism by power of the motor; and a controller controlling an operation of the motor, wherein when the separation roller is rotationally driven in the forward rotation direction, the feeding roller is configured to be passively rotatable with respect to the separation roller, wherein a rotation direction of the motor when the cam member switches the medium feeding mechanism from the first state to the second state is the same as a rotation direction of the motor when the separation roller rotates in the forward rotation direction, wherein when a rotation direction of the motor when rotating the separation roller in the reverse rotation direction is defined as a first rotation direction, and a rotation direction of the motor when rotating the separation roller in the forward rotation direction is defined as a second rotation direction, a one-way clutch restricts a rotation of the cam member by power of the motor rotating in the first rotation direction, wherein the cam member comprises a detected section rotating with the cam member, wherein a detector detecting the detected section is disposed to detect the detected section when the medium feeding mechanism is in the second state, and wherein the controller operates the motor by a predetermined number of rotations in the second rotation direction starting from a state in which the detector detects the detected section prior to an operation of feeding the medium, the operation being performed by the motor rotated in the first rotation direction.

11. The medium feeding device according to claim 10, wherein the controller rotates the motor in the second rotation direction after the feeding operation is completed, and stops the motor when the detector detects the detected section.

12. The medium feeding device according to claim 10, wherein the controller rotates the motor in the second rotation direction until the detector detects the detected section in a case in which the detector does not detect the detected section when the device is activated or when an instruction of the feeding operation is input.

13. The medium feeding device according claim 10, wherein the medium feeding mechanism is located upstream of the feeding roller in the feeding direction, and includes a restriction section pivoting so as to allow a movement of the medium to the feeding direction in the first state, and regulate a movement of the medium to the feeding direction in the second state by an operation of the cam member.

14. The medium feeding device according to claim 13, wherein the medium feeding mechanism is located upstream of the feeding roller in the feeding direction, configured to be displaceable between a contact state of coming into contact with the medium and a separation state of separating from the medium, and includes an upstream roller that draws out the medium toward the feeding roller by being rotationally driven in the contact state, and wherein the restriction section restricts a displacement of the upstream roller from the separation state to the contact state in the second state of the medium feeding mechanism.

15. The medium feeding device according to claim 10, further comprising:

a transport driving roller located downstream of the separation roller in the feeding direction and rotationally driven by power of the motor; and a transport driven roller passively rotated with respect to the transport driving roller, wherein the transport driving roller rotates in the forward rotation direction when the separation roller rotates in the reverse rotation direction, and rotates in the reverse rotation direction when the separation roller rotates in the forward rotation direction.

16. An image reading apparatus comprising:

a reading section that reads an image of the medium; and the medium feeding device according claim 10 that feeds the medium toward the reading section.

* * * * *